US009151542B2

(12) United States Patent
Otahal

(10) Patent No.: US 9,151,542 B2
(45) Date of Patent: Oct. 6, 2015

(54) HEAT EXCHANGER

(75) Inventor: Klaus Otahal, St. Florian (AT)

(73) Assignee: Mahle International GmbH (DE)

( * ) Notice: Subject to any disclaimer, the term of this patent is extended or adjusted under 35 U.S.C. 154(b) by 347 days.

(21) Appl. No.: 13/325,908

(22) Filed: Dec. 14, 2011

(65) Prior Publication Data

US 2012/0152506 A1 Jun. 21, 2012

(30) Foreign Application Priority Data

Dec. 15, 2010 (DE) ..... 10 2010 063 141

(51) Int. Cl.

| | |
|---|---|
| ***F28D 9/00*** | (2006.01) |
| ***F28F 9/007*** | (2006.01) |
| *F28F 3/08* | (2006.01) |
| *F01M 5/00* | (2006.01) |
| *F28D 21/00* | (2006.01) |

(52) U.S. Cl.

CPC ..... *F28D 9/005* (2013.01); *F28F 9/0075* (2013.01); *F01M 5/002* (2013.01); *F28D 2021/0089* (2013.01); *F28F 2225/00* (2013.01); *F28F 2225/08* (2013.01); *F28F 2280/06* (2013.01)

(58) Field of Classification Search

CPC ..... F28F 2225/08; F28F 2225/00; F28F 2225/02; F28F 2280/06; F28F 9/0075; F28F 3/08; F28D 9/005; F28D 9/0062; F28D 2021/0089; F01M 5/002

USPC ..... 165/109.1, 167, 906, 916

See application file for complete search history.

(56) References Cited

U.S. PATENT DOCUMENTS

| | | | | |
|---|---|---|---|---|
| 1,056,385 | A * | 3/1913 | Walker | 165/167 |
| 1,874,054 | A * | 8/1932 | Levinsen | 165/167 |
| 2,379,671 | A | 7/1945 | Wetherby-Williams | |
| 4,708,199 | A * | 11/1987 | Yogo et al. | 165/167 |
| 5,069,276 | A * | 12/1991 | Seidel | 165/166 |
| 5,392,848 | A * | 2/1995 | Bottcher et al. | 165/164 |
| 5,513,702 | A * | 5/1996 | Tajima et al. | 165/167 |
| 5,797,450 | A | 8/1998 | Kawabe et al. | |
| 5,927,394 | A * | 7/1999 | Mendler et al. | 165/166 |
| 7,377,308 | B2 * | 5/2008 | Ware | 165/167 |
| 7,533,717 | B2 * | 5/2009 | Hummel et al. | 165/167 |
| 8,544,532 | B2 | 10/2013 | Bradu et al. | |
| 2002/0104645 | A1 | 8/2002 | Yoshida et al. | |
| 2007/0084809 | A1 * | 4/2007 | Bradu et al. | 211/59.4 |

(Continued)

FOREIGN PATENT DOCUMENTS

| | | | |
|---|---|---|---|
| CN | 2219474 | Y | 2/1996 |
| CN | 101317069 | A | 12/2008 |

(Continued)

OTHER PUBLICATIONS

English abstract for JP10-185462.

(Continued)

*Primary Examiner* — Tho V Duong
*Assistant Examiner* — Aaron Isenstadt
(74) *Attorney, Agent, or Firm* — Fishman Stewart Yamaguchi PLLC

(57) ABSTRACT

A heat exchanger may include a connection plate for fastening to a component and a plurality of pan elements stacked on top of each other and soldered together adjacent to the connection plate. At least one of the pan elements may be arranged directly adjacent to the connection plate may have an outwardly protruding, flange-like rim configured to rest against the connection plate and stiffen the same.

20 Claims, 3 Drawing Sheets

(56) References Cited

U.S. PATENT DOCUMENTS

| | | | | |
|---|---|---|---|---|
| 2007/0289724 | A1* | 12/2007 | Hoof et al. | 165/149 |
| 2008/0216987 | A1 | 9/2008 | Thumm et al. | |
| 2008/0257536 | A1 | 10/2008 | Kolblin et al. | |
| 2009/0032231 | A1* | 2/2009 | Komoda et al. | 165/166 |
| 2010/0206516 | A1 | 8/2010 | Muller-Lufft et al. | |
| 2011/0024095 | A1* | 2/2011 | Kozdras et al. | 165/164 |

FOREIGN PATENT DOCUMENTS

| | | | |
|---|---|---|---|
| DE | 19805439 | A1 | 8/1999 |
| EP | 1645828 | A2 | 4/2006 |
| EP | 2267390 | A2 * | 12/2010 |
| JP | H06265282 | A | 9/1994 |
| JP | 10185462 | A | 7/1998 |
| JP | 2006183903 | A | 7/2006 |
| JP | 2006183969 | A | 7/2006 |
| WO | WO-2007038871 | A1 | 4/2007 |
| WO | WO 2010136108 | A2 * | 12/2010 |
| WO | WO-2010136108 | A2 | 12/2010 |

OTHER PUBLICATIONS

EP Search Report for EP-11191380.2.
English abstract for CN2219474.
English Abstract for JP 2006183903.
English Abstract for JP 2006183969.
English Abstract for JP H06265282.
English Abstract for DE 19805439.
English Abstract for EP 1645828.
Office Action for JP 2011-274873, mailed Aug. 4, 2015, 10 pp.

* cited by examiner

HEAT EXCHANGER

CROSS-REFERENCES TO RELATED APPLICATION

This application claims priority to German Patent Applications 10 2010 063 141.8 filed on Dec. 15, 2010 which is hereby incorporated by reference in its entireties.

TECHNICAL FIELD

The present invention relates to a heat exchanger, in particular an oil-water heat exchanger, comprising a connection plate for fastening to a component, according to the preamble of the claim 1.

BACKGROUND

Heat exchangers, in particular so-called oil-water heat exchangers on internal combustion engines are subjected to significant oscillations and vibrations, which is the reason why a connection plate via which the heat exchanger is mounted, for example, to an internal combustion engine, is formed comparatively thick and thus strengthened. However, a connection plate strengthened in this manner results in a comparatively high weight and requires in addition a certain installation space which can be a problem in particular with respect to a steadily decreasing installation space available within modern engine compartments.

SUMMARY

The present invention is concerned with the problem of providing an improved or at least alternative embodiment for a heat exchanger of the generic type which is in particular characterized by a compact and, at the same time, stable design.

This problem is solved according to the invention by the subject matter of the independent claim 1. Advantageous embodiments are subject matter of the dependent claims.

The present invention is based on the general idea to provide on a heat exchanger known per se, for example, an oil-water heat exchanger, comprising a connection plate for fastening to an internal combustion engine and further comprising a plurality of pan elements stacked on top of each other and soldered together, on at least the pan element directly adjacent to the connection plate, an outwardly protruding, flange-like rim which, with the heat exchanger being installed, rests with the entire surface against the connection plate, for example, is rigidly connected to the same, in particular soldered thereto, and thus stiffens said connection plate. With the flange-like rim, the material thickness required for stiffening the connection plate is therefore provided only at said rim and not over the entire surface of the connection plate, whereby the latter can be designed considerably thinner and lighter compared to connection plates known from the prior art. The thinner configuration allows a compact design of the heat exchanger, wherein the flange-like rim of the pan element directly adjacent to the connection plate provides the required stiffness.

In an advantageous refinement of the solution according to the invention, at least two pan elements arranged directly adjacent to the connection plate have in each case an outwardly protruding, flange-like rim, wherein said rims and the connection plate rest against each other in parallel and preferably over the entire surface and are rigidly connected to each other. Thus, the at least two rims and the connection plate connected thereto ensure the required stiffness of the connection plate without the need that the latter has to have a considerably larger thickness in the entire region. Of course, the second pan element is configured differently with respect to its rim than the first pan element; in particular, the outwardly protruding rim extends farther towards the first pan element so as to ensure a flat rest of the rims against each other and against the connection plate. If further pan elements are equipped with such rims, said rims have also to be formed correspondingly with respect to their shape.

Further important features and advantages of the invention arise from the sub-claims, from the drawings, and from the associated description of the figures based on the drawings.

It is to be understood that the above mentioned features and the features still to be explained hereinafter are not only usable in the respective mentioned combination but also in other combinations or alone without departing from the context of the present invention.

BRIEF DESCRIPTION OF THE DRAWINGS

Preferred exemplary embodiments of the invention are illustrated in the drawings and are explained in the following description in more detail, wherein identical reference numbers refer to identical, or similar, or functionally identical components.

In the figures, schematically

DETAILED DESCRIPTION

Figure 1:
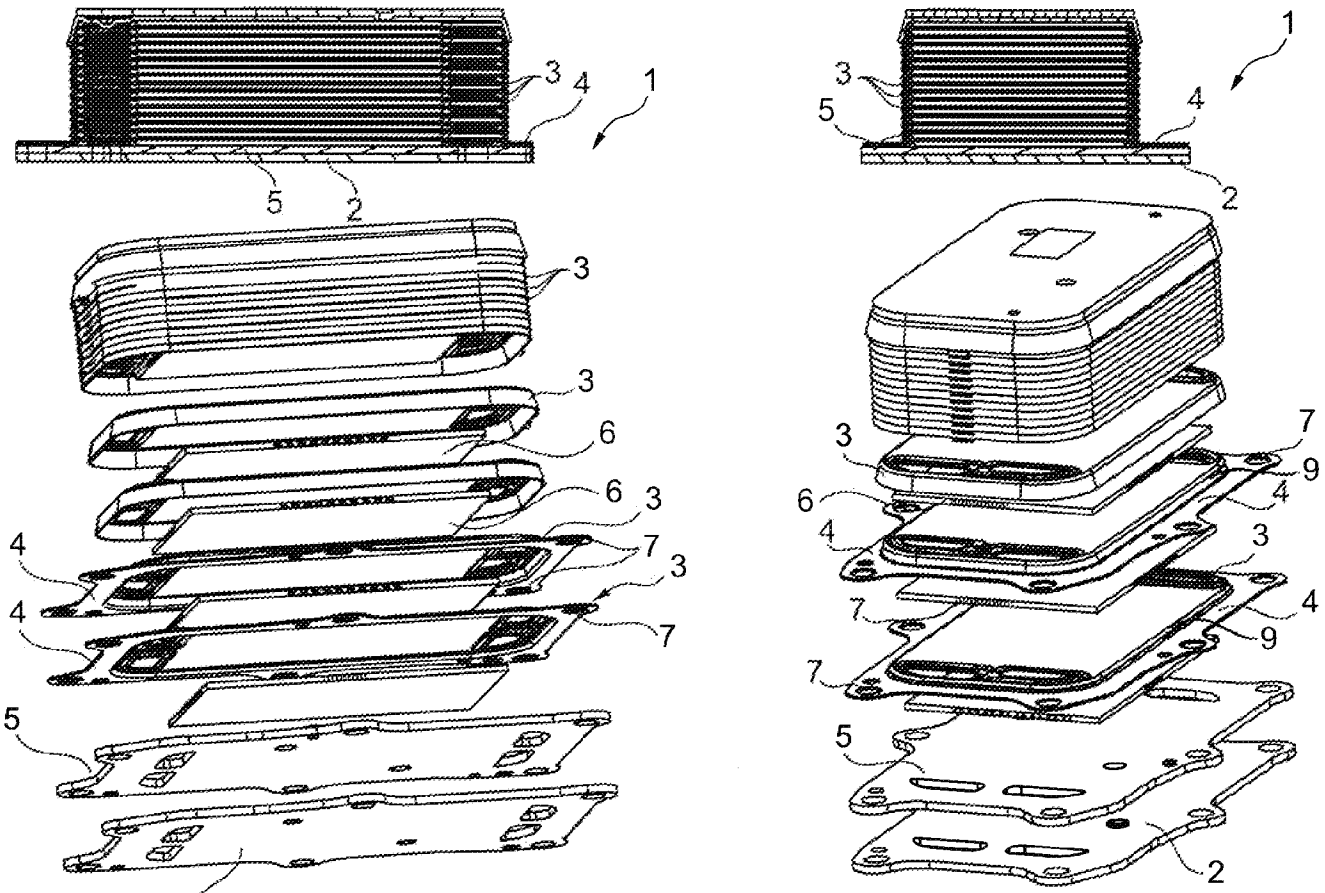
FIG. 1 shows an exploded view from different directions and an associated sectional view through a heat exchanger according to the invention.
Figure 2:
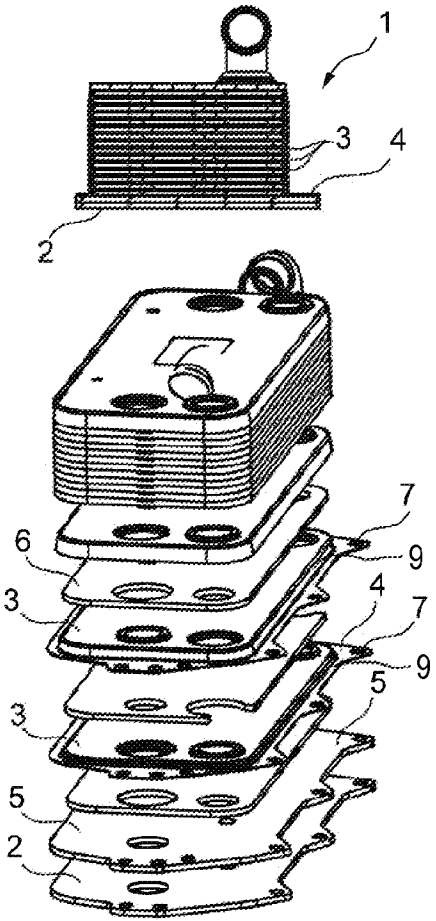
FIG. 2 shows a view as in FIG. 1, but with a slightly modified heat exchanger.
Figure 2:
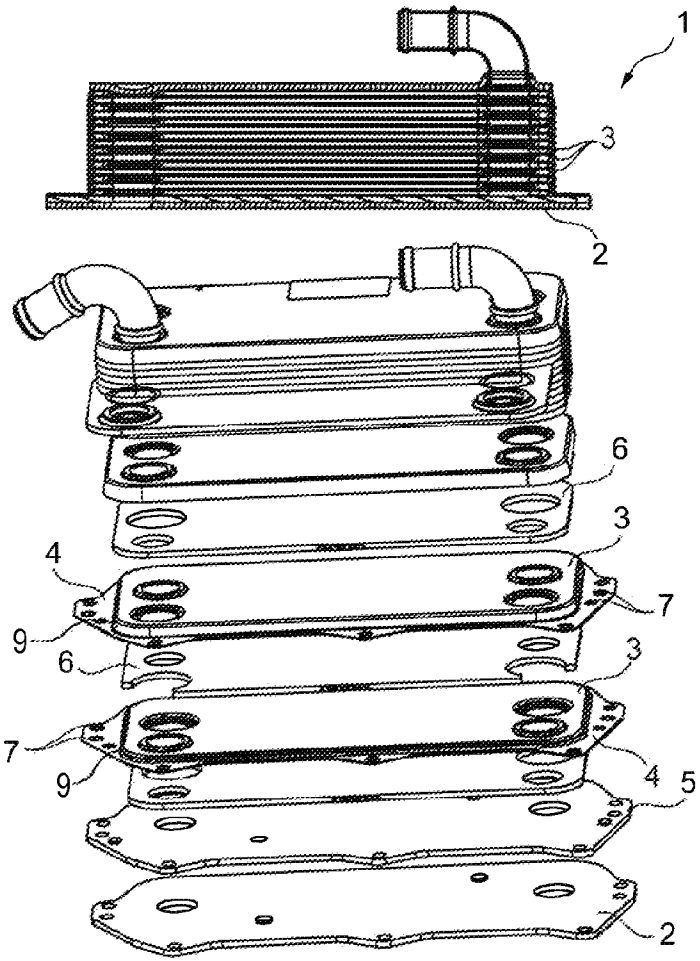
Figure 3:
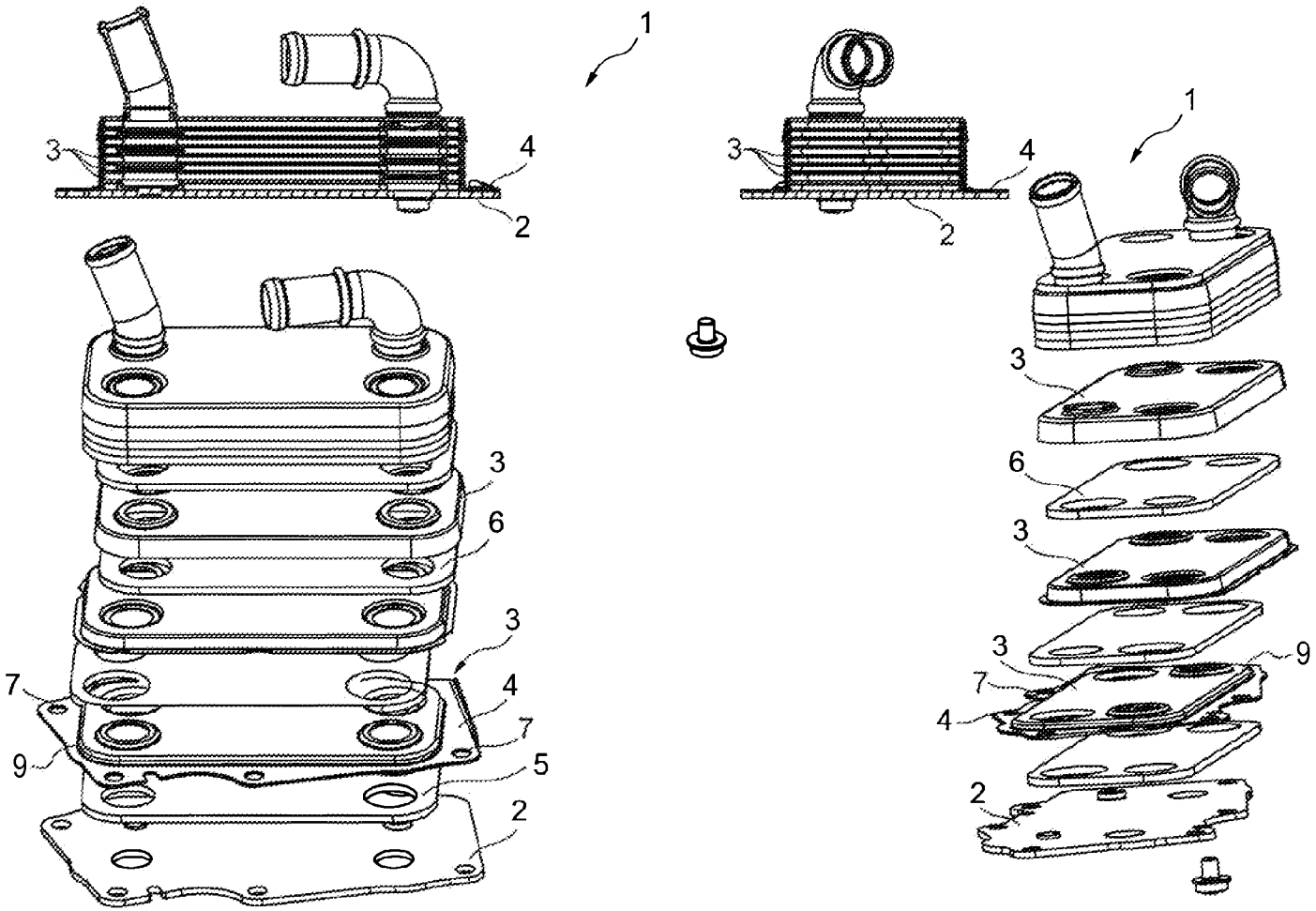
FIG. 3 shows again an exploded view of a heat exchanger according to the invention in a different embodiment.

According to the FIGS. 1 to 3, a heat exchanger 1 according to the invention, which can be designed, for example, as oil-water heat exchanger, comprises a connection plate 2 for fastening to a component, in particular for fastening to an internal combustion engine, and a plurality of pan elements 3 stacked on top of each other. According to the invention, at least the pan element 3 directly adjacent to the connection plate 2 has an outwardly protruding, flange-like rim 4 which, when the heat exchanger 1 is installed, rests against the connection plate 2 and helps stiffening the same. When viewing FIGS. 1 to 3, it is apparent that in case of the two heat exchangers 1 shown there, two pan elements 3 directly adjacent to the connection plate 2 have said outwardly protruding, flange-like rim 4.

In order to make the heat exchanger 1 insensitive to oscillations and vibrations of an internal combustion engine to which it is connected, up to now, the connection plate, also referred to as base plate, was built in a rigid manner, that is, with a comparatively large thickness. In contrast, the connection plate 2 of the heat exchanger 1 according to the invention can be designed considerably thinner and thus lighter because the stiffness responsible for the resistance against vibrations and oscillations is generated by the rims arranged on the pan elements 3. Still viewing FIGS. 1 to 3, it is apparent that between the connection plate 2 and the first adjacent pan element 3, a spacer plate 5 is arranged. Alternatively, this can also be considered as a two-piece connection plate 2, wherein both parts are very thinly shaped and thereby it is easier to solder the heat exchanger 1. The spacer plate 5 can be used optionally and can also serve for stiffening purposes. Also, through the spacer plate 5, the risk of damage or injury can be reduced because the rims 4 of the pan element 3 rest directly via the spacer plate 5 against the connection plate 2. Moreover, between the individual pan elements 3 themselves, turbulence generators in the form of turbulence sheets 6 or other means suitable for this can be provided which generate a turbulent flow within the heat exchanger 1 and thus can ensure an improved heat exchange.

Due to the downwardly pointing, circumferential pan edges 9 and the rims 4 of the pan elements 3 which protrude outwardly in a flange-like manner, a first heat exchanger channel can extend directly adjacent to the connection plate 2. In case of this type of heat exchanger 1, supply and discharge of the two media can take place through the connection plate 2 as shown in FIG. 1 or, as shown in FIGS. 2 and 3, the one medium, mostly oil, flows through the connection plate 2 and the other medium through the upper cover plate 8. The pan elements 3 are designed in such a manner that they alternatingly form in themselves the vertical supply and discharge lines of both media and the horizontal heat exchanger channels of both media. For details of such pan elements, reference is made, for example, to DE 20 2010 003 080 U1 or AT 407 920 B.

It is further shown that passage openings 7 are provided on the flange-like, outwardly protruding rim 4, wherein through said passage openings, fastening screws are fed, thereby clamping the pan elements 3 equipped with the rim 4 against the connection plate 2. For a tight connection of the pan elements 3 among each other and to the spacer plate 5 or connection plate 2, said pan elements can be soldered together in particular in the region of the rim 4. In general, the heat exchanger 1 can be connected to a non-shown filter, in particular to an oil filter.

Moreover, with the heat exchanger 1 according to the invention, the following advantages can be implemented:

a significantly improved force transmission via the rims 4 into the connection plate 2 and thus a stiffening of the connection plate 2, without notch effect, a low risk of damage or injury because the rims 4 of the pan elements 3 rest directly via the spacer plate 5 against the connection plate 2, a compact design of the heat exchanger according to the invention due to the thickness of the connection plate 2 reduced according to the invention.

The invention claimed is:

1. A heat exchanger comprising: a connection plate for fastening to a component, a plurality of pan elements stacked on top of each other and soldered together mounted on the connection plate, the plurality of pan elements including at least a first pan element and a second pan element arranged away from the connection plate with respect to the first pan element, the first pan element and the second pan element respectively having a peripheral pan edge extending in a direction of the connection plate;

wherein the first pan element is arranged proximate to the connection plate and has an outwardly protruding, flange-like rim extending from the respective pan edge transversely to the direction of the connection plate, the rim of the first pan element having a profile congruous to the connection plate, and the second pan element is arranged proximate to the first pan element and includes an outwardly protruding, flange-like rim extending from the respective pan edge transversely to the direction of the connection plate, wherein the rim of the second pan element overlays the rim of the first pan element; and wherein the rim of the second pan element extends farther towards the connection plate in relation to the rim of the first pan element such that the rims of the first and second pan elements rest in parallel with the connection plate and thereby stiffens the same.

2. The heat exchanger according to claim 1, further comprising a spacer plate arranged between the connection plate and the first pan element.

3. The heat exchanger according to claim 1, further comprising a turbulence sheet arranged between the first and second pan elements, wherein the rims of the first and second pan element extend beyond a perimeter of the turbulence sheet.

4. The heat exchanger according to claim 1, wherein the respective flange-like rims of the first and second pan elements define a plurality of passage openings configured to receive fastening screws.

5. The heat exchanger according to claim 2, wherein the first pan element is secured via soldering to at least one of the spacer plate and the connection plate.

6. The heat exchanger according to claim 1, wherein the heat exchanger is connected to a filter.

7. The heat exchanger according to claim 6, wherein the filter is an oil filter.

8. The heat exchanger according to claim 3, further comprising a spacer plate arranged between the connection plate and the first pan element.

9. The heat exchanger according to claim 1, wherein the first pan element contacts the connection plate exclusively via the rim of the first pan element.

10. The heat exchanger according to claim 9, wherein each flange-like rim defines a plurality of passage openings configured to receive fastening screws.

11. The heat exchanger according to claim 1, wherein the rims of the first pan element and the second pan element respectively project outwardly beyond a perimeter defined by the plurality of pan elements stacked on top of each other.

12. The heat exchanger according to claim 1, wherein the connection plate further includes a first connection plate arranged between the first pan element and a second connection plate, the first connection plate and the second connection plate respectively including a complementary peripheral surface corresponding to the rim of the first pan element, wherein the rims of the first pan element and the second pan element rest in parallel with the respective peripheral surfaces of the first connection plate and the second connection plate.

13. The heat exchanger according to claim 1, wherein the connection plate defines a peripheral surface receiving the respective rims of the first pan element and the second pan element, wherein the peripheral surface faces the plurality of pan elements.

14. The heat exchanger according to claim 13, wherein the first pan element directly contacts the connection plate exclusively via the associated rim.

15. The heat exchanger according to claim 2, wherein the spacer plate includes a periphery congruous to the flange-like rim of the first pan element, wherein the rim of the first pan element overlays the connection plate via the spacer plate.

16. The heat exchanger according to claim 15, wherein the first pan element is secured via soldering to the spacer plate.

17. The heat exchanger according to claim 15, wherein the rims of the first and second pan elements rest in parallel with the connection plate via the spacer plate.

18. A heat exchanger, comprising:

a connection plate for securing to an internal combustion engine;

a plurality of stacked pan elements mounted on the connection plate, the plurality of pan elements including a first pan element arranged proximate to the connection plate and a second pan element arranged proximate to the first pan element and positioned away from the connection plate with respect to the first pan element, the first pan element and the second pan element respectively having a peripheral pan edge extending in a direction of the connection plate;

wherein the first pan element includes an outwardly protruding, flange-like rim extending from the associated pan edge transversely to the direction of the connection plate and having a profile congruous to a peripheral surface of the connection plate, the peripheral surface of the connection plate facing the plurality of stacked pan elements, wherein the rim of the first pan element rests along the peripheral surface of the connection plate;

wherein the second pan element includes an outwardly protruding, flange-like rim extending from the associated pan edge transversely to the direction of the connection plate and having a profile conforming to the rim of the first pan element, the rim of the second pan element overlaying the rim of the first pan element; and wherein the first pan element directly contacts the connection plate exclusively via the associated rim, and the rim of the second pan element extends farther towards the connection plate in relation to the rim of the first pan element such that the rims of the first and second pan elements rest in parallel with and are secured to the peripheral surface of the connection plate.

19. The heat exchanger according to claim 18, wherein the connection plate comprises a first connection plate disposed between the first pan element and a second connection plate, the first and second connection plate respectively including a complementary peripheral surface corresponding to the rim of the first pan element, wherein the rim of the first pan element overlays the second connection plate via the first connection plate.

20. The heat exchanger according to claim 18, wherein the rim of the first pan element and the second pan element respectively project outwardly beyond a perimeter defined by the plurality of stacked pan elements.

* * * * *